US009833027B2

(12) United States Patent
Taylor et al.

(10) Patent No.: US 9,833,027 B2
(45) Date of Patent: Dec. 5, 2017

(54) UNITARY GARMENT HEATING DEVICE

(71) Applicant: INNOVATIVE SPORTS INC., Eugene, OR (US)

(72) Inventors: Christopher Colby Taylor, Eugene, OR (US); Scott Freeman, Eugene, OR (US)

(73) Assignee: INNOVATIVE SPORTS INC., Eugene, OR (US)

( * ) Notice: Subject to any disclaimer, the term of this patent is extended or adjusted under 35 U.S.C. 154(b) by 223 days.

(21) Appl. No.: 14/606,065

(22) Filed: Jan. 27, 2015

(65) Prior Publication Data

US 2015/0208739 A1 Jul. 30, 2015

Related U.S. Application Data

(60) Provisional application No. 61/932,909, filed on Jan. 29, 2014.

(51) Int. Cl.

| | |
|---|---|
| ***H05B 3/34*** | (2006.01) |
| ***H05B 3/36*** | (2006.01) |
| ***A41D 13/005*** | (2006.01) |
| ***H05B 1/02*** | (2006.01) |
| ***H05B 3/18*** | (2006.01) |
| ***H05B 3/56*** | (2006.01) |
| ***A41D 1/00*** | (2006.01) |

(52) U.S. Cl.

CPC ..... *A41D 13/0051* (2013.01); *A41D 1/002* (2013.01); *H05B 1/0272* (2013.01); *H05B 3/18* (2013.01); *H05B 3/342* (2013.01); *H05B 3/56* (2013.01); *H05B 2203/003* (2013.01); *H05B 2203/007* (2013.01); *H05B 2203/014* (2013.01); *H05B 2203/036* (2013.01)

(58) Field of Classification Search

None

See application file for complete search history.

(56) References Cited

U.S. PATENT DOCUMENTS

| | | | |
|---|---|---|---|
| 2,862,097 | A | 11/1958 | Negromanti |
| 3,298,368 | A | 1/1967 | Charos |
| 4,656,334 | A | 4/1987 | Endo et al. |

(Continued)

FOREIGN PATENT DOCUMENTS

| | | |
|---|---|---|
| WO | WO2005112179 | 4/2007 |

*Primary Examiner* — Joseph M Pelham

(74) *Attorney, Agent, or Firm* — Jerry Haynes Law

(57) ABSTRACT

A unitary garment heating device that integrates with a garment to provide uniform heat throughout the garment. The device includes a plurality of nodes that position on various areas of the garment to distribute the heat. The nodes are fabricated from a conductive metallic yarn. A continuous conduit having no junctions carries current for generating heat, and connects the nodes to form a unitary heating device. The conduit is fabricated from the same material as the nodes, thereby forming a unitary device. The lack of junctions on the conduit helps eliminate problems such as shorts, and moisture exposure form rain or sweat. The conduit runs in a series circuitry to minimize shorts and arcing. The conduit is covered with a laminate and urethane to inhibit contact with moisture. A communication apparatus, such as a smart phone, monitors and regulates the temperature. A power supply and microprocessor are also attached.

16 Claims, 8 Drawing Sheets

(56) References Cited

U.S. PATENT DOCUMENTS 4,764,665 A 8/1988 Orban et al.
4,983,814 A * 1/1991 Ohgushi ..... D02G 3/441 219/212
5,081,341 A 1/1992 Rowe
5,893,991 A 4/1999 Newell
6,381,482 B1 * 4/2002 Jayaraman ..... A61B 5/6805 600/388
6,548,789 B1 4/2003 Rock et al.
6,723,967 B2 4/2004 Rock et al.
6,941,775 B2 9/2005 Sharma
6,963,055 B2 * 11/2005 Rock ..... D04B 1/04 219/211
7,064,299 B2 * 6/2006 Green ..... H05B 3/347 219/515
7,307,242 B1 12/2007 Chen
7,462,035 B2 12/2008 Lee et al.
8,133,264 B1 3/2012 Lafontaine
2002/0086204 A1 * 7/2002 Rock ..... A41D 13/0051 429/120
2003/0178413 A1 9/2003 Rock et al.
2003/0218004 A1 * 11/2003 Yoneyama ..... B62D 1/065 219/528
2005/0155961 A1 7/2005 Gilligan et al.
2006/0151475 A1 * 7/2006 Horvath ..... F24D 13/02 219/529
2006/0185727 A1 8/2006 Matan
2007/0271939 A1 11/2007 Ichigaya
2008/0083720 A1 4/2008 Gentile et al.
2008/0083721 A1 * 4/2008 Kaiserman ..... A43B 3/0005 219/211
2008/0083740 A1 * 4/2008 Kaiserman ..... A43B 7/04 219/520
2008/0116189 A1 5/2008 Fernandez et al.
2008/0210728 A1 9/2008 Bihn
2008/0223844 A1 9/2008 Cronn
2008/0245786 A1 * 10/2008 Sharma ..... H05B 3/347 219/529
2009/0032520 A1 2/2009 Cronn
2009/0057289 A1 3/2009 Williams
2009/0144887 A1 6/2009 Orandi
2010/0308725 A1 12/2010 Trzecieski
2013/0037531 A1 2/2013 Gray et al.
2013/0306614 A1 11/2013 Fey, Jr.
2015/0136753 A1 * 5/2015 Cronn ..... H05B 3/00 219/211
2015/0257205 A1 * 9/2015 Hase ..... H05B 3/16 219/539

* cited by examiner

UNITARY GARMENT HEATING DEVICE

CROSS-REFERENCE TO RELATED APPLICATION

The present application claims priority from U.S. Provisional Application Ser. No. 61/932,909, entitled UNITARY GARMENT HEATING DEVICE, filed Jan. 29, 2014, which is hereby incorporated herein by reference in its entirety.

FIELD OF THE INVENTION

The present invention relates generally to a unitary garment heating device and in particular, the unitary garment heating device includes a plurality of fabric heating nodes connected by a unitary fabric heating conduit to generate uniform heat throughout a garment.

BACKGROUND OF THE INVENTION

Various types of heated garments have been suggested in the past. Conventional winter garments can keep the wearer warm because they are capable of slowing down the heat transfer between the cold atmosphere and the wearer's body. Such garments cannot produce heat, however some conventional electrically heated garments are tends to be bulky, heavy and inflexible, thus cumbersome and uncomfortable to wear. It is no surprise that such devices have not been incorporated into everyday clothing. Such heating devices remain uncomfortable to wear on a regular basis and are prone to fatigue as the heating elements are repeatedly folded, stretched or twisted in the ordinary course of wear and tear.

There is therefore a need exists in the garment industries to provide a electrically heating device capable of being incorporated into various manufactured dress articles such as jackets, shirts, blankets, etc, that is of high performance having remotely controllable interface to set and regulate thermostat temperature, less bulk, light weight, increased flexibility, extended heat generation duration, increased durability and ease of support when compared to the prior art. Such a heating apparatus would preferably also be capable of being designed, retrofitted and manufactured in a standardized manner.

Numerous innovations for garment heating device have been provided in the prior art as described below. Even though these innovations may be suitable for the specific purposes to which they address, however, they differ from the present invention.

For example, U.S. Pat. No. 6,963,055, issued on 8 Nov. 2005, to Rock et al., teaches a electric resistance heating/warming composite fabric articles have a fabric layer having a first surface and an opposite, second surface, and an electric resistance heating/warming element in the form of a conductive yarn mounted upon first surface of the fabric layer, e.g. in embroidery stitching, and adapted to generate heating/warming when connected to a power source. A barrier layer may be positioned, for example, at least adjacent to the first or second surface of the fabric layer.

U.S. Pat. No. 5,081,341, issued on 14 Jan. 1992, to Rowe, teaches a heated comfort product such as an electrical blanket having an elongate electrical resistance element is connected in a particular manner to an AC power line by connecting the ends of conductors used in the element at a common end to respective AC power lines so as to achieve reduced or non-detectable electromagnetic and/or electrostatic radiating fields from the comfort product.

U.S. Pat. No. 4,656,334, issued on 7 Apr. 1987, to Shinichi Endo et al., teaches a bed warmer such as an electric blanket initially subject to a preparatory high temperature set value, the supply of power to a heater is controlled such that a warmer temperature is automatically recovered to a preset temperature value provided by a temperature setter from the preparatory high temperature set value when a bodily temperature detector detects that the user has goes to bed.

US Pub. No. 2008/0223844, published on 18 Sep. 2008, to Cronn, teaches a heating apparatus comprising a textile based heating element, a power source and related components. The heating apparatus can be designed, retrofitted or manufactured into articles of clothing or equipment such as gloves, vests, jackets, shirts, pants, socks, insoles, mitts, hand warmers, seats and other common articles. A textile based heating element comprises one or more conductive wires stitched into a fabric carrier. Various conductive wire configurations can desirably adjust the resistance of the textile based heating element thereof. Methods of manufacture and use are disclosed in conjunction with the heating apparatus.

Major failures have been experienced by large outdoor clothing companies who have attempted to deploy wearable heating systems in outerwear. These failures related to the use of conduits embedded in the fabric to heat specific portions of a garment, and those conduits were then joined in a network of heating areas within the garment using wires. This created connection points within the network. Those connection points, between the wires and the heating conduits within the network, overheated and burned, resulting in total failures of the product lines, hazards to the public, and major recalls by the US Consumer Product Safety Commission. Poor engineering, and a lack of testing of these interconnection points for heat output while the system was operating was the cause of these failures. In one instance, the product was recalled when it burned because the conduit strands were placed too close together in the fabric, thereby generating too much heat. Poor engineering and lack of testing were to blame for that failure as well. The invention solves these issues by eliminating these interconnection points, and appropriately spacing resistors within fabric to prevent burning. The following is a list of these recalls, and which company(s) each recall refers to: http://www.cpsc.gov/en/Recalls/2010/Ardica-Recalls-Heated-Jackets-and-Vests-Due-to-Burn-Hazard/ CPSC Recall #10-186 Ardica, Mountain Hardware Radiance Jackets, Refugium Jackets, and Sitka Dutch Oven Vests; http://www.cpsc.gov/en/Recalls/2013/Columbia-Sportswear-Recalls-Seven-Models-of-Heated-Jackets/ CPSC Recall #13-104 Columbia Sportswear Omni-Heat heated jackets; http://www.cpsc.gov/en/Recalls/2013/Gerbings-Recalls-Heated-Jacket-Liners/ CPSC Recall #13-171 Gerbing Heated Jacket Liner.

It is apparent now that numerous innovations for electrically heating garments have been provided in the prior art that are adequate for various purposes. Furthermore, even though these innovations may be suitable for the specific purposes to which they address, accordingly, they would not be suitable for the purposes of the present invention as heretofore described. Thus a unitary garment heating device and in particular, the garment device includes a plurality of fabric heating nodes connected by a unitary fabric heating conduit to generate uniform heat throughout a garment and which can be controlled by a remote communication device is needed.

SUMMARY OF THE INVENTION

The present invention of a unitary garment heating device includes a plurality of fabric heating nodes connected by a conduit to generate uniform heat throughout a garment.

The unitary garment heating device for generating heat at a predetermined area of a garment and uniformly transferring heat throughout the garment, comprising a power supply; a conduit comprising a unitary conductor having no junctions is connected to the power supply, wherein the unitary conduit is configured to generate heat and is disposed in the predetermined area of the garment in a series circuitry configuration so as to enhance uniform distribution of the heat throughout the conduit; a thermostat disposed to operatively join with the conduit, wherein the thermostat is configured to indicate a temperature of the garment and communicates with a communication apparatus so as to monitor and regulate the thermostat, thereby controlling the power supply to the conduit; and a plurality of nodes having no junctions are configured to overlay the conduit from opposite sides to form a proximal layer and a distal layer around the conduit, wherein the proximal layer engages the garment, forming a barrier against the skin and the distal layer forms the opposite cover and integrates with the conduit and the layers are configured to transfer the controlled heat generated by the conduit to the plurality of nodes of the garment thereby enabling the nodes to provide uniform heating throughout the garment, further the plurality of nodes are spaced at a predetermined space from each other so as to provide sufficient flexibility to the garment.

It is an object of the invention is to provide a garment heating device for generating heat at a predetermined area of a garment and uniformly transferring heat throughout the garment.

It is another object of the invention is to provide the garment heating device to position on a front and back area of the garment (e.g. a jacket). Heat may be transferred uniformly or in sectional areas throughout the garment through the use of a single conduit, rather than individual circuitry. In areas where the nodes are not in contact with the garment, the conduit provides heat thereto.

It is still another object of the invention is to provide equal and sufficient spacing between the nodes of the garment heating device so as to provide sufficient flexibility to the garment.

It is still another object of the invention is to provide a series circuitry configuration of the conduit which enables the conduit to interweave throughout each node in a proximal pattern without risk of arcing or shorting out while facilitating uniform heating throughout the garment.

It is further another object of the invention is to provide a urethane coating over the conduit and the nodes so as to inhibit contact with moisture.

It is yet another object of the invention is to provide a garment heating device which includes a thermostat and a microprocessor, wherein the thermostat is operatively joined with the conduit and is configured to indicate a temperature of the garment and the microprocessor controlling the flow of current through the conduit in response to the signal received from the thermostat.

It is further another object of the invention is to provide a communication apparatus such as a smart phone that communicates with the thermostat through a software application. The software application provides a display of the temperature on the garment or areas throughout the garment. The software application may also regulate the temperature based on external conditions, such as region, activity being performed, or time of day.

It is another object of the invention to provide a power supply that is microprocessor controlled and a source of power that includes a battery, a fuel cell, a solar cell or an external power source or any combination thereof, further the power supply is attached with a USB port 710 and a battery charging circuit that allows the power supply to recharge other peripheral devices carried in the garment through a USB or similar port or ports within the power supply. Within the power supply, the USB or similar peripheral charging ports and the charging circuit are configured and positioned to minimize interference with functionality and comfort of the garment.

Other features and aspects of the invention will become apparent from the following detailed description, taken in conjunction with the accompanying drawings, which illustrate, by way of example, the features in accordance with embodiments of the invention. The summary is not intended to limit the scope of the invention, which is defined solely by the claims attached hereto.

BRIEF DESCRIPTION OF THE DRAWINGS

The invention will now be described, by way of example, with reference to the accompanying drawings, in which:

FIG. 5A illustrates a Low Temperature, FIG. 5B illustrates a Moderate Temperature, FIG. 5C illustrates a High Temperature, and FIG. 5D illustrates a Therapy Grade Temperature, in accordance with an embodiment of the present invention;

FIG. 6A illustrates a temperature control interface for the garment, FIG. 6B illustrates a compass while showing set temperature and current temperature for the garment and FIG. 6C illustrates detailed weather condition of a selected location over the map while showing set temperature and current temperature for the garment.

Like reference numerals refer to like parts throughout the various views of the drawings.

DETAILED DESCRIPTION OF THE INVENTION

Figure 1:
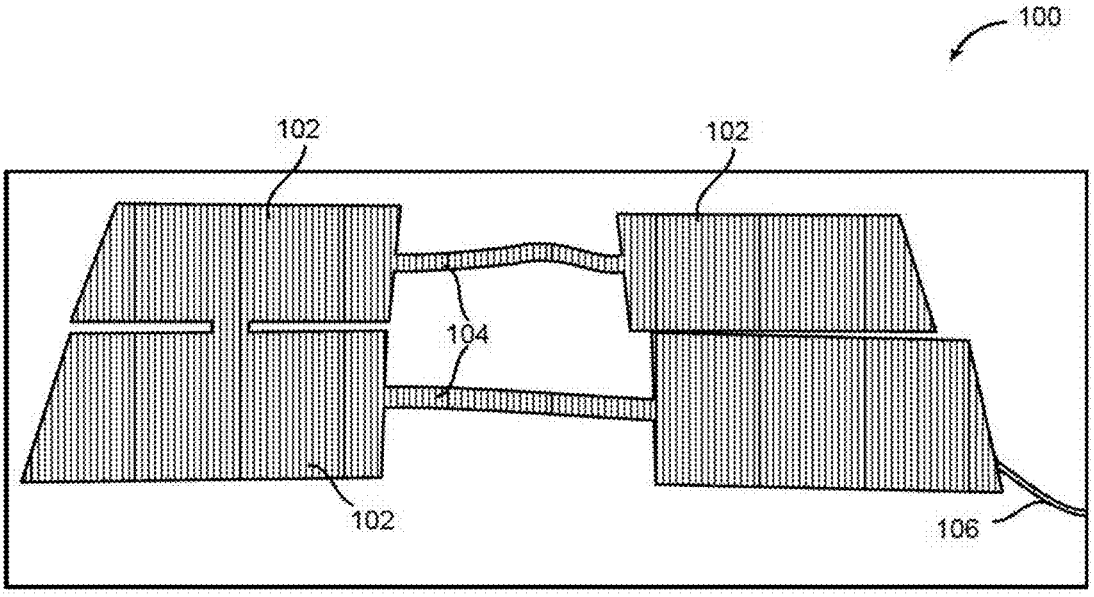
FIG. 1 illustrates a detailed perspective view of an exemplary unitary garment heating device, in accordance with an embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

In one embodiment of the present invention, described in FIGS. 1-7, a unitary garment heating device 100 integrates with a garment to generate heat in a predetermined area of the garment, such as the back and chest areas. The device 100 transfers the heat uniformly throughout the garment with a unitary, continuous conduit 104. The conduit 104 carries a current that generates the heat. The conduit 104 traverses in a series circuitry 400, so as to enhance uniform distribution of heat and minimize circuitry problems on the garment. The continuous configuration of the conduit 104 also helps enhance the structural integrity of the device 100, and eliminates the need for junctions. In some embodiments, pluralities of fabric heating nodes 102 are connected by the conduit 104. The nodes 102 serve to distribute the heat from the conduit 104 onto the predetermined areas of the garment. Similar to the conduit 104, the plurality of nodes 102 do not have junctions, but in essence, are one piece of conductive fabric divided and spaced to create sufficient flexibility on a garment. The nodes 102 and the conduit 104 are fabricated from substantially the same material—a metallic yarn 702.

In some embodiments, each node 102 may be sufficiently flexible as to enable normal movement while wearing the garment. Further, the plurality of nodes 102 may be spaced as to enable bending, twisting, and folding over. These various orientations may provide comfort and flexibility, along with warmth, during use of the garment. The plurality of fabric heating nodes 102 may be fabricated from a metallic yarn 702 that integrates into the body of the nodes 102 by weaving or embroidering thereto. The metallic yarn 702 may include a copper and stainless steel composition, and may be configured to conduct a current, whereby the current provides the thermal energy to generate heat.

In some embodiments, the plurality of fabric heating nodes 102 are connected by a conduit 104, having substantially the same composition as the nodes 102. The conduit 104 forms a single component that traverses the nodes 102 to carry an electrical current or other energy transfer, for providing the heat. In another embodiment, each node 102 may comprise two layers that overlay the conduit 104 from opposite sides, as illustrated in FIG. 1A. A proximal layer 114 engages the garment, forming a barrier against the skin. A distal layer 116 may form the opposite cover, and integrate with the conduit 104. An adhesive may help integrate the conduit 104 to the distal layer 116. Each layer 114, 116 is configured to transfer a predetermined amount of heat generated by the conduit 104 to the garment. This sandwich configuration enables the conduit 104 to remain a unitary, continuous member having no junctions.

In some embodiments, the conduit 104 forms a single conducting member with no junctions, such as crimps, splices, or solders. This unitary, continuous configuration provides numerous advantageous and novelty to the device 100. Those skilled in the art will recognize that electrical junctions are points where power loss may occur as current is interrupted and shorts are possible. Further, junctions may be susceptible to wearing, and thereby contamination by moisture or dirt. In some embodiments, the conduit 104 traverses the nodes 102 in a series circuitry configuration 400, rather than a parallel or other type of circuitry. The series circuitry 400 of the conduit 104 and nodes 102 enables all sections of the conduit 104 to carry the same amount of current; and thereby generate substantially the same units of heat in each node 102. In one embodiment, the conduit 104 may include substantially the same metallic yarn 702 composition as the nodes 102, as illustrated in FIG. 1B. The conduit 104 includes a plurality of laminated layered sheets 110 that are coated with a urethane 112 to inhibit exposure to moisture and other contaminants, as illustrated in FIGS. 1A and 1B. In production, a unitary conductor 118 may include the metallic yarn 702 which may be formed in one continuous piece and coated with a urethane 120. An adhesive may help integrate the conduit 104 to the distal layer 116.

In some embodiments, the device 100 may include a thermostat that indicates the temperature at specific areas of the garment based on the heat generated by the conduit 104. The thermostat may communicate with a remote communication apparatus that serves to monitor and regulate the temperature remotely. A software application may provide a graphical display of the heat generated and control functions for controlling the heat generated in the device 100.

A power supply 106 for powering the conduit 104 may position on the nodes 102. The power supply 106 may include, without limitation, a battery, a fuel cell, or an external power source. A microprocessor 600 may control the amount and type of current flowing through the conduit 104. The power supply 106 provides power for the conduit 104, the thermostat, and the microprocessor/microcontroller 600.

A first aspect of the present invention provides a unitary garment heating device 100 for generating heat throughout a garment through a unitary conduit 104, comprising:

- a plurality of nodes 102 configured to at least partially transfer heat to a garment, the plurality of nodes 102 disposed to interconnect, the plurality of nodes 102 comprising a heat conducting fabric, the plurality of nodes 102 further comprising a proximal layer 114 and a distal layer 116;
- a conduit 104 comprising a unitary conductor 118 having no junctions, the unitary conductor 118 including a metallic yarn 702 which may be coated with urethane 120 the conduit 104 further comprising the heat conducting fabric, the conduit 104 configured to generate heat for transfer to each node 102, the conduit 104 disposed to join each node 102 into a series circuitry 400 configuration, the conduit 104 further disposed to position between the proximal layer 114 and the distal layer 116;

a power supply 106 configured to provide power to the conduit 104; and a thermostat disposed to operatively join with the plurality of nodes 102 and/or the conduit 104, the thermostat configured to indicate a temperature of the garment, the thermostat being configured to communicate with a communication apparatus, the communication apparatus configured to monitor and regulate the thermostat.

In a second aspect, the garment comprises a jacket. The device 100 positions on a front and back area of the jacket. Heat may be transferred uniformly or in sectional areas throughout the garment through the use of a single conduit 104, rather than individual circuitry. In areas where the nodes 102 are not in contact with the garment, the conduit 104 provides heat thereto.

In another aspect, the heat conducting fabric comprises a metallic yarn 702. The metallic yarn 702 comprises a copper and stainless steel composition.

In another aspect, the plurality of nodes 102 comprises four nodes. The four nodes are sufficiently spaced to enable flexible movement while wearing the garment. Each node connects through the conduit 104 in a series circuitry 400 configuration.

In another aspect, the series circuitry 400 configuration of the conduit 104 enables the conduit 104 to interweave throughout each node 102 in a proximal pattern without risk of arcing or shorting out. This generates a more compact, efficient heat.

In another aspect, the conduit 104 comprises substantially the same material composition as the plurality of nodes 102. The conduit 104 further is fabricated from a plurality of sheets that are coated with a urethane. The urethane helps to inhibit contact with moisture. The conduit 104 is disposed to position between the proximal layer and the distal layer, while interconnecting the plurality of nodes 102. The conduit 104 integrates with the distal layer. The proximal layer forms a barrier to inhibit contact between the conduit 104 and the garment or skin. The proximal layer comprises a fleece material.

In another aspect, the power supply 106 provides power to the device 100, and includes a battery, a fuel cell, or an external power source. The power supply 106 is configured and positioned to minimize interference while wearing the garment.

In another aspect, the communication apparatus comprises a smart phone that communicates with the thermostat through a software application. The software application provides a display of the temperature on the garment or areas throughout the garment. The software application may also regulate the temperature based on external conditions, such as region, activity being performed, or time of day.

Figure 1A:
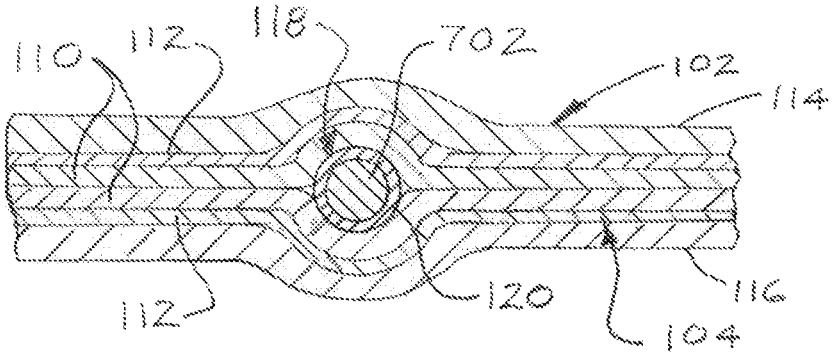
FIG. 1A is a cross-sectional view of a typical fabric heating node of the unitary garment heating device and FIG. 1B is a cross-sectional view illustrating a typical conduit of the unitary garment heating device.
Figure 1B:
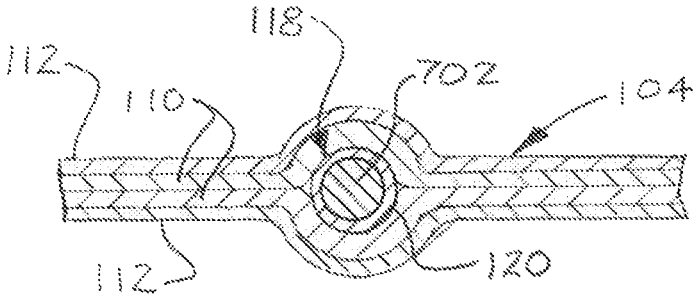

As referenced in FIG. 1, the unitary garment heating device 100 comprises a plurality of nodes 102 and a conduit 104 configured to at least partially transfer heat to a garment. The garment may include, without limitation, a jacket, a sweater, a pair of trousers, and a hat. In other embodiments, the garment may, however, include a blanket or a bed sheet. The pluralities of nodes 102 are disposed to form an integral heating relationship with the garment. Each node may interconnect through the unitary conduit 104. In this manner, a uniform heating device 100 is maintained.

Figure 2:
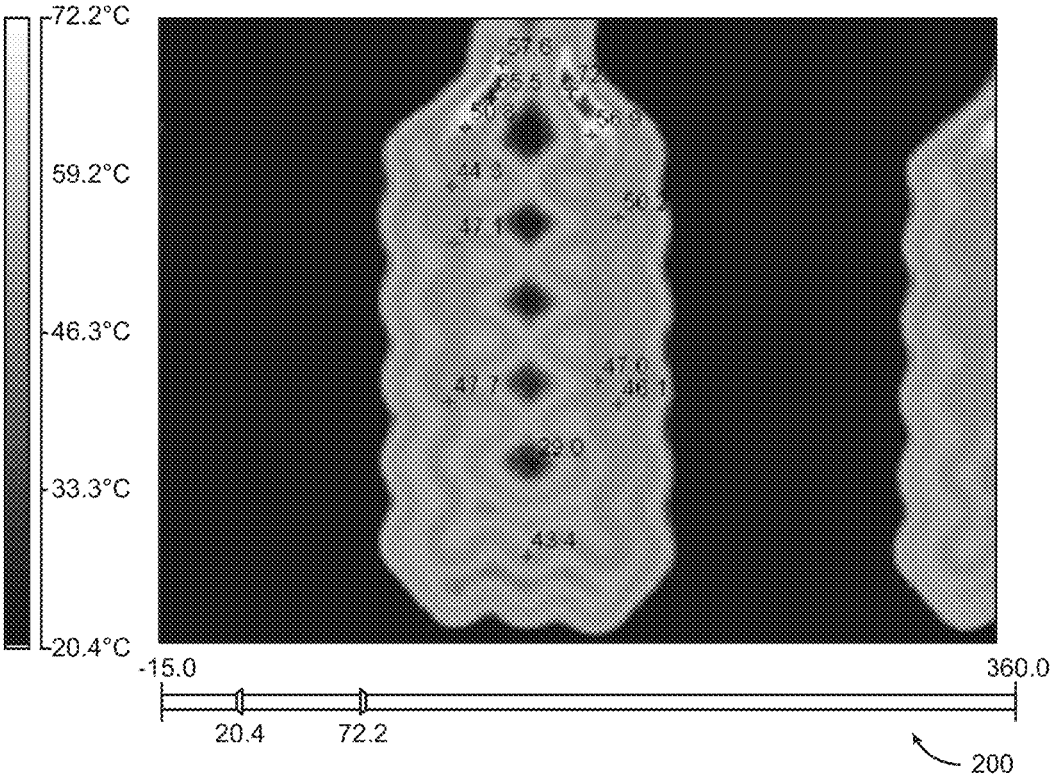
FIG. 2 illustrates a front view of an exemplary thermal image showing uniform heat distribution on a garment, in accordance with an embodiment of the present invention.

In some embodiments, the pluralities of nodes 102 include a heat conducting fabric, such as a metallic yarn 702. The metallic yarn 702 may comprise copper and/or stainless steel material. In other embodiments, other materials conducive to conduction may, however, be utilized. In one embodiment, the metallic yarn 702 may include a strand of Bekaert yarn 3.6 meters long, and having a resistance of 2.5 ohms. It is significant to note that the unitary composition of the device 100 creates a uniform resistance that provides uniform heat distribution and eliminates bottle neck heat buildup in the garment. This uniform heat distribution on the garment may be observed in a thermal image 200 (FIG. 2).

In some embodiments, the plurality of nodes 102 also includes a proximal layer and a distal layer. The proximal layer engages the garment, forming a barrier to inhibit contact between the conduit 104 and the garment or skin. The proximal layer may include a fleece material. The distal layer may form the opposite cover, and integrate with the conduit 104 through weaving or embroidering.

Figure 3:
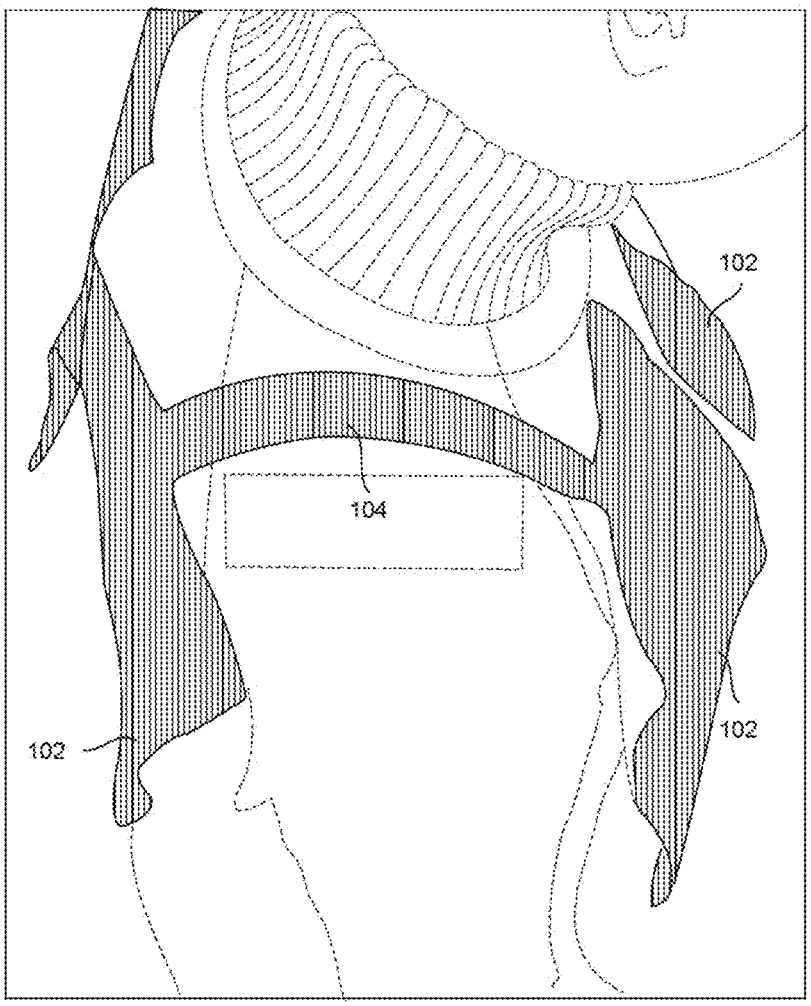
FIG. 3 illustrates a detailed perspective view of two exemplary nodes on a chest area, and two exemplary nodes on a back area, with a continuous conduit connecting the nodes, in accordance with an embodiment of the present invention.

Turning now to FIG. 3, the plurality of nodes 102 comprises four nodes, with two nodes engaging the chest area and two nodes engaging the back area of the garment. The nodes 102 may be connected by the conduit 104. The generated heat is continuous throughout the conduit 104 and the nodes 102. This continuity minimizes the needs for junctions, crimps, solders, and other connection points that create shorts and are susceptible to moisture. In some embodiments, the spacing between the pluralities of nodes 102 is sufficient to enable flexibility and bending. The flexibility provided by having multiple nodes 102, rather than a single node, is efficacious for enabling a user to actively wear a garment. In another embodiment, the plurality of nodes 102 comprises three nodes. Any number of nodes 102 may, however, be utilized depending on the type and size of garment.

The device 100 further comprises a conduit 104 fabricated from substantially the same material of metallic yarn 702 as the plurality of nodes 102. The conduit 104 further is fabricated from a plurality of sheets that are coated with a urethane composition. The urethane helps to inhibit contact with moisture. Those skilled in the art will recognize that moisture from exterior elements or sweat is common on garments. This moisture exposed on an open junction or uncovered conduit 104 may cause shorts or corrosion to the device 100.

In some embodiments, the conduit 104 is disposed to position between the proximal layer and the distal layer, while interconnecting the plurality of nodes 102. The conduit 104 integrates with the distal layer. The proximal layer forms a barrier to inhibit contact between the conduit 104 and the skin. The proximal layer comprises a fleece material. In other embodiments, any nonwoven material, cotton, polyester, or synthetic fiber may, however, be used.

The conduit 104 comprises a unitary conductor 118 having no junctions. The lack of junctions and sharp corners in the conduit 104 helps minimize fraying of the metallic yarn 702 material at connection points. Also, crimp connectors used with certain types or extended lengths of stainless steel yarn may overheat when connected to heated yarns and current is run through the joined network of elements. The lack of junctions helps eliminate some of these problems. The conduit 104 comprises substantially the same material as the plurality of nodes 102. The conduit 104 configured to carry and generate heat for transfer to each node. Additionally, the conduit 104 not only carries current for transferring heat to the nodes 102, but also provides heat. In this manner, garment areas not in contact with the nodes 102 are heated through contact with the conduit 104.

Figure 4:
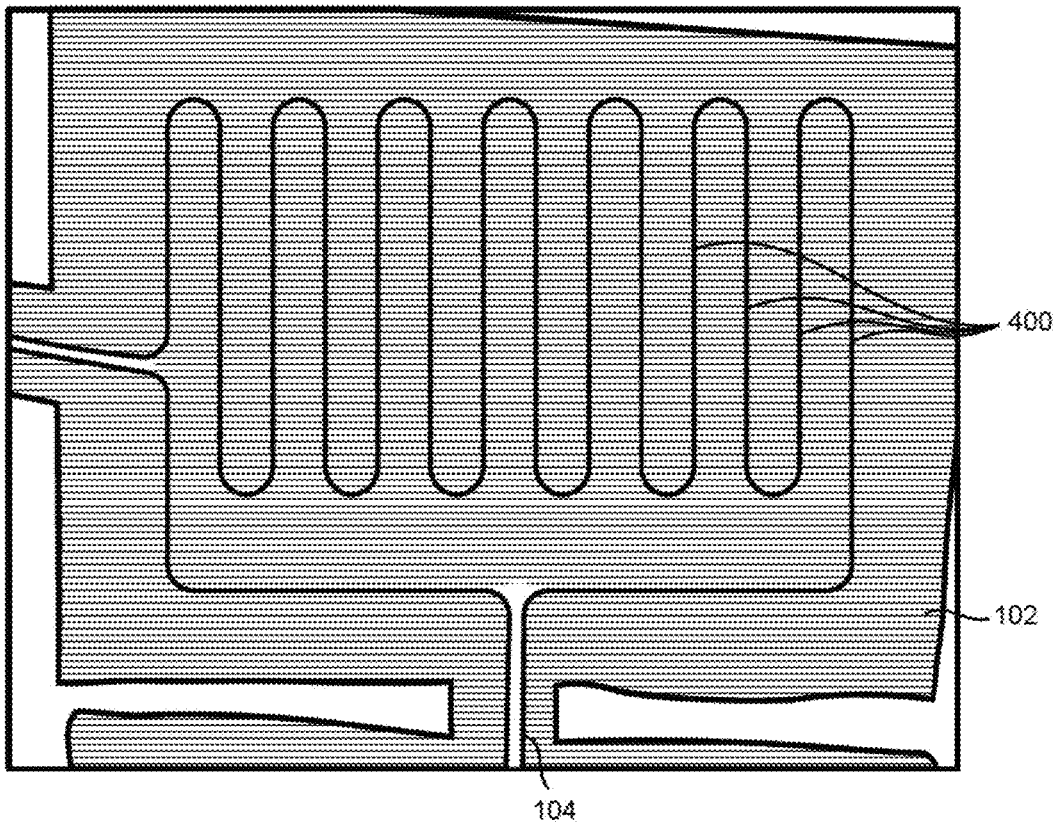
FIG. 4 illustrates a top view of an exemplary conduit traversing an exemplary node in a series circuit configuration, in accordance with an embodiment of the present invention.

As referenced in FIG. 4, the conduit 104 is disposed to join each node 102 into a series circuitry configuration 400. The series circuitry 400 configuration of the conduit 104 enables the conduit 104 to interweave throughout each node 102 in a proximal pattern without risk of arcing or shorting out. This generates a more compact, efficient heat. Those skilled in the art will recognize that a parallel circuitry may create arcing between electrical conduits, and may also result in uneven distribution of heat. The series configuration of the conduit 104 inhibits the arcing and creates more uniform heating throughout the garment.

In some embodiments, a thermostat disposed to operatively join with the plurality of nodes 102 and/or the conduit 104. The thermostat is configured to indicate a temperature of the garment. In one embodiment, the device 100 includes input for a 20K thermistor resistor component for feedback to control the actual temperature of the device 100. This resistor can be connected to a probe to detect and control actual temperature in addition to only relying on a user's subjective comfort levels.

Figure 5A:
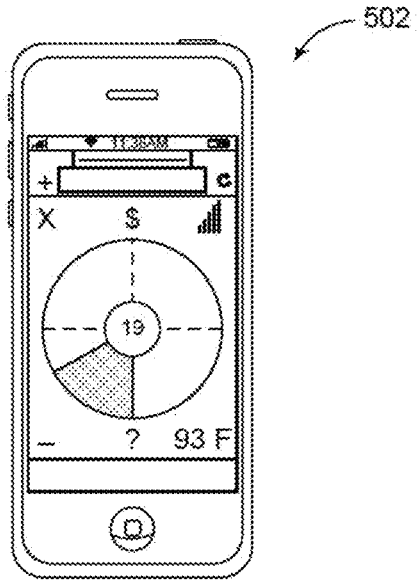
FIGS. 5A, 5B, 5C, and 5D illustrate a frontal view of exemplary communication apparatus displays showing a temperature for a garment, where
Figure 5B:
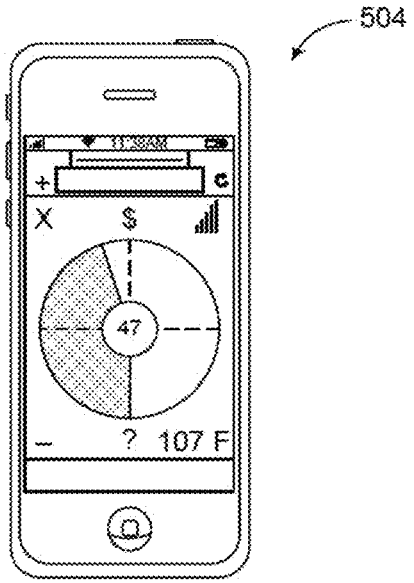
Figure 5C:
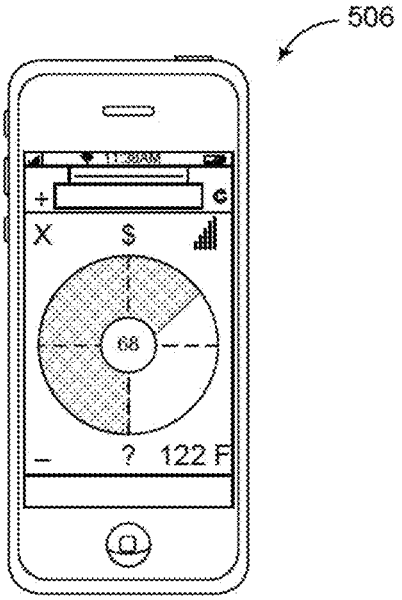
Figure 5D:
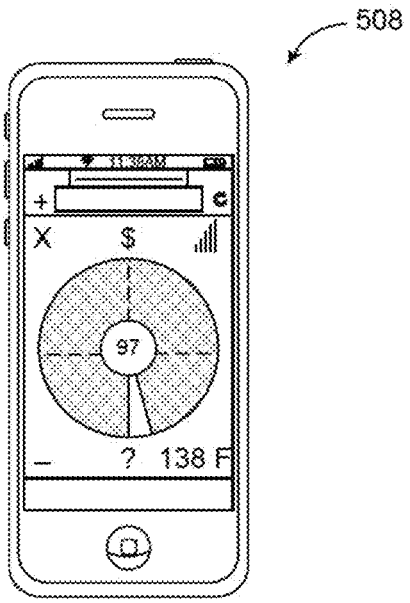

In some embodiments, the thermostat may include a receiver to communicate with a communication apparatus, such as a smart phone. The display on the smart phone, as referenced in FIGS. 5A, 5B, 5C, and 5D, can include the temperature depicted in a graph and color coded. The actual temperature, though, may be affected by the ambient temperature. In other embodiments, the communication apparatus for monitoring and regulating the temperature of the device 100 may include a remote control station, a server, a computer, and a laptop. The communication apparatus operatively communicates with the thermostat and a microprocessor 600 on the device 100 to optimally monitor and regulate the thermostat. For example, the communication apparatus can display and enable control of a Low Temperature 502 between 0°-25° Fahrenheit (FIG. 5A), a Moderate Temperature 504 between 26°-50° Fahrenheit (FIG. 5B), a High Temperature 506 between 51°-75° Fahrenheit (FIG. 5C), and for therapy, such as massages and the like, a therapy Temperature 508 between 76°-100° Fahrenheit (FIG. 5D). These temperatures may be regulated remotely or directly through the thermostat.

Figure 6A:
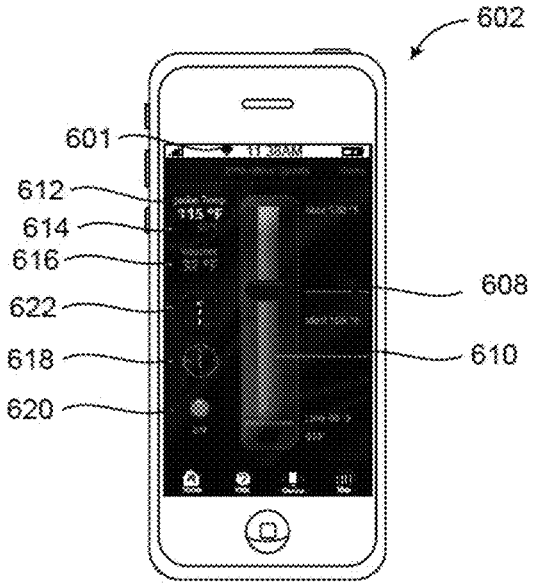
FIGS. 6A, 6B and 6C illustrate a frontal view of exemplary communication apparatus displays showing set temperature and current temperature for a garment, where
Figure 6B:
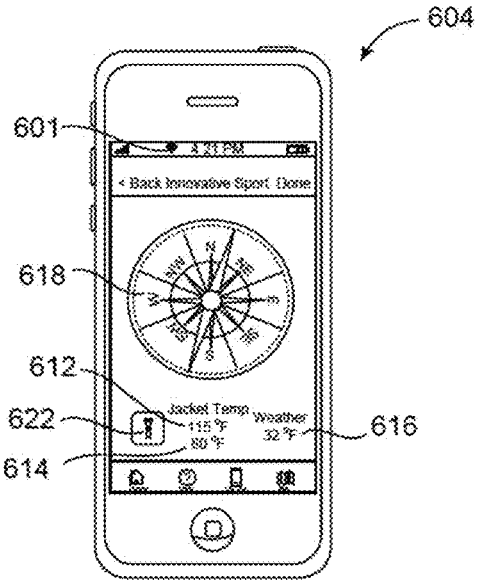
Figure 6C:
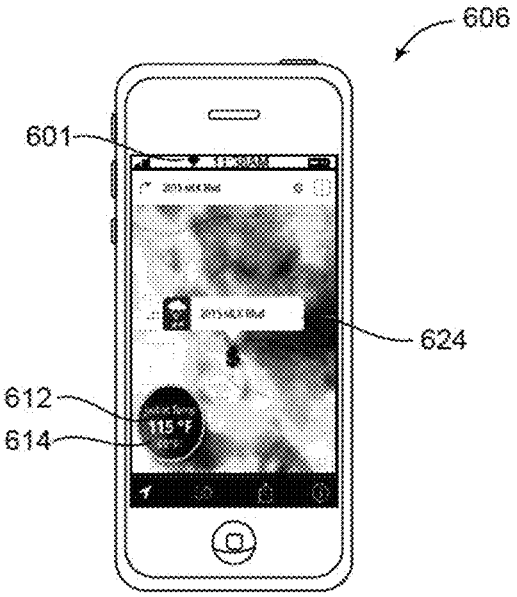

In another embodiment, the display on the smart phone, as referenced in FIGS. 6A, 6B and 6C, shows other exemplary smart phone application interfaces. A radar key symbol 601 on the top of the smart phone display shows the running status of the smart phone application interfaces. As shown in FIG. 6A, the interface 602 can include an easy to control jacket temperature controller button 608, that can control temperature of the jacket by just sliding the button 608 over a mercury reading bar 610. The mercury reading bar 610 indicates different levels such as OFF, Low temperature (90° F.), Medium temperature (105° F.) and Maximum temperature (130° F.) on the bar 610. The interface 602 also shows a set temperature value 612 for the jacket and current jacket temperature value 614. It also shows current weather condition such as current atmospheric temperature 616 on the display. A compass 618, a Bluetooth status button 620 and a flash light button 622 are shown on the interface 602. As shown in FIG. 6B, the interface 604 used during navigation showing the compass 618 for determining direction of navigation while showing other parameters such as the flash light button 622, the set temperature value 612 for the jacket, the current jacket temperature value 614, and the current atmospheric temperature 616 on the display. As shown in FIG. 6C, the interface 606 displays detailed weather condition 624 of a selected location over the map while showing other parameters such as the set temperature value 612 for the jacket and the current jacket temperature value 614 on the interface. Other several modifications to the smart phone application interface can be done to show and control the jacket temperature without departing from the scope of the invention.

In some embodiments, a power supply 106 provides power to the conduit 104 and the thermostat. The power supply 106 may include, without limitation, a battery, a fuel cell, or an external power source. The external power source may include an electrical socket that joins the device 100 through an electrical cable. The power supply 106 is configured and positioned to minimize interference with functionality and comfort of the garment. In some embodiments, a USB port 710 may operatively attach to the power supply 106 and transfer excess power to electronic phones, laptops, and computers. Those skilled in the art will recognize that joining the power supply 106 with the USB port 710 reduces the number of components, and thereby reduces manufacturing costs.

Those skilled in the art will recognize that varying parameters such as, the power supply 106, yarn dimensions, resistance of the conduit 104, and garment thickness may provide different heating capacities. For example, without limitation, the power supply 106 voltage required to obtain 120° F. on the yarn in the nodes 102 and conduit 104 would require 9 W/m of power. If 1 meter of yarn in a glove garment, with a 3.7 volt battery, the current may flow at 2432 mA (9/3.7V) and the resistance 1.52 ohm (3.7V/2.432 A). The power supply 106 would last for 54 minutes at full power. In another embodiment, the yarn may, however, include a resistance of 2.6 ohm/m. This results in the resistance of 1.52 ohm/m not being possible to obtain with one single yarn. It would require two pieces of 58 cm of 4.5 ohm/m yarn. These embodiments assume a series circuitry 400 configuration. If parallel, the consumption would be 2840 mA and the one battery would last 45 minutes at full power at 120° F. In this case, the maximum discharge current of the battery should be in the range of 3000 mA, but the issues with parallel discussed above would be present. With two batteries of 3.7V (for a total of 7.4V), 1.16 m of yarn would be needed to obtain 120° F. on the yarn. In this case, the consumption of electrical current would be about 1420 mA, and power supply 106 would last approximately 1 hour, 30 minutes.

Figure 7:
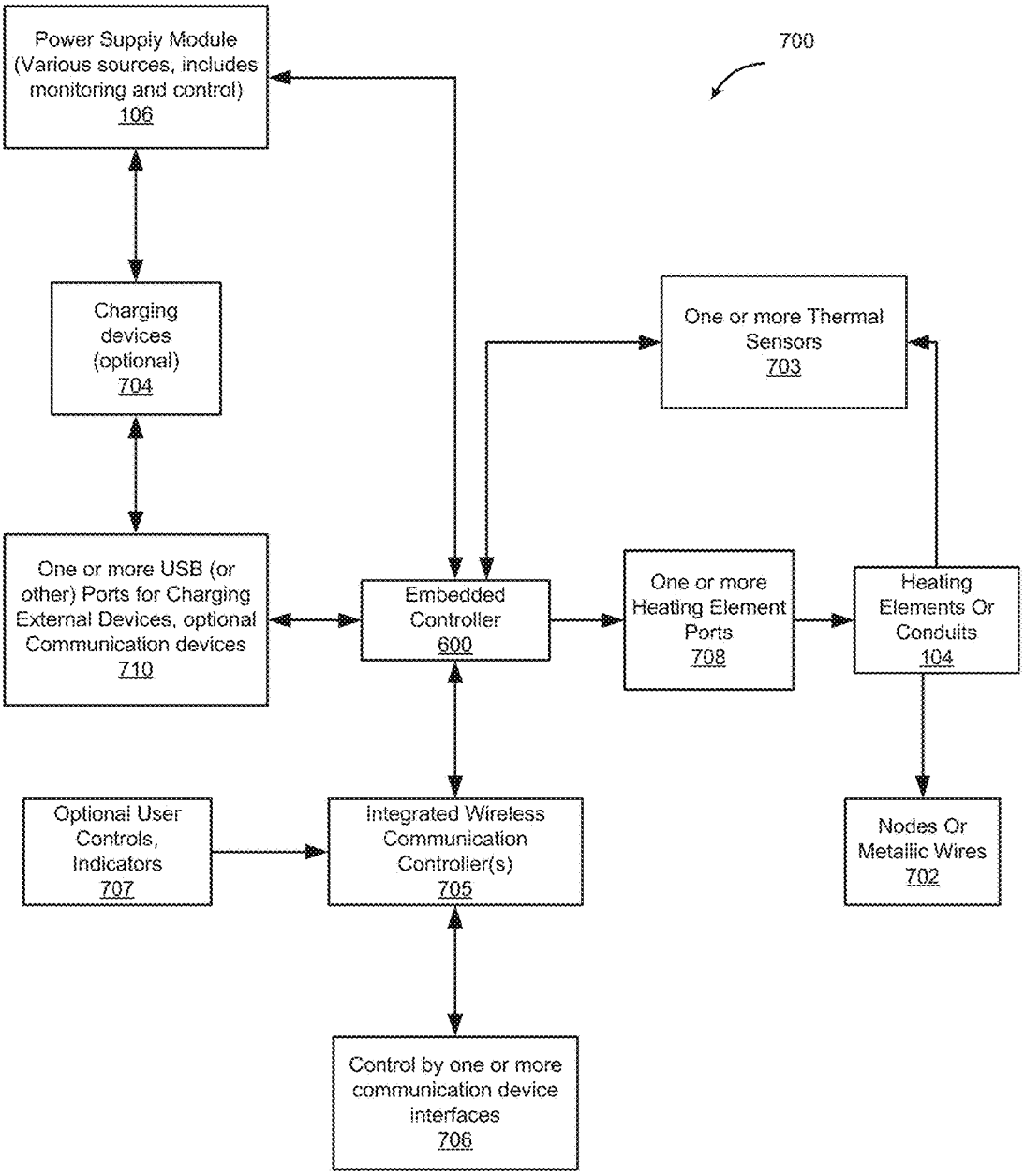
FIG. 7 illustrates a block diagram of an exemplary power delivery and thermal management system, in accordance with an embodiment of the present invention.

FIG. 7 references the key components of the unitary garment heating device 100 utilizing a power delivery and thermal management system 700 that allows the power supply 106 to heat the metallic yarn 702 through the conduit 104 thereby providing uniform heating throughout the garment. The power supply 106 is attached with a USB port 710 and a battery charging circuit 704 that allows recharging of the power supply from the USB port 710 on a laptop or PC. An on board DC-to-DC converter is present to step up the 5-volt signal to a level adequate to charge the respective power supply 106. Further the charging circuit 704 is configured and positioned to minimize interference with functionality and comfort of the garment. The power source optionally charges a portable electronic item with the power supply charger 704 through the USB port 710, which may operatively transfers excess power to electronic phones, laptops, and computers. The thermal management system 700 regulates the temperature of the garment with a communication apparatus regulator display 706 upon receiving signal from the thermostats or thermal sensors 703. The temperature of the garment in association with heating element or the conduit 104 is sensed by the sensor 703, wherein the sensor sends the signal to the embedded microprocessor/controller 600 and is transmitted to the communication device through the integrated wireless communication controller 705. The communication devices are equipped with application user interface to provide control over the parameters via the communication apparatus regulator display 706. The microprocessor 600 combined with another USB port or any other port acting as a heating port 708, which includes an input for a thermistor resistor component for feedback to control the actual temperature of the conduit 104. Other additional signals, user controls and indicators 707 can be sent and received from the integrated wireless communication controller 705, so as to regulate the temperature of the garment or generate other statistical or graphical information which may be used to alert the user or other several applications. These multifunctional aspects may be done simultaneously and remotely. In other embodiments, additional functions related to heating the garment may, however, be allowed through the power delivery and thermal management system 700.

The controller 600 may include, without limitation, a MicroChip model PIC 12C672 microcontroller 600. In some embodiments, the USB port 708 may include an input for a 20K thermistor resistor component for feedback to control the actual temperature of the conduit 104. In another embodiment, the microcontroller 600 comprises a power metal-oxide-semiconductor field-effect transistor (MOSFET) system for the actual power control which is driven by a pulse width modulation signal derived from the microcontroller 600 and associated firmware.

Multiple power sources 106 like a direct electrical power supply, or battery as a power source or receiving to power from one or more electric equipments through USB port or a solar panel can supply power to the unitary garment heating device 100. Further the device can be equipped with multiple temperature sensors and thermostats 703 may be connected to different areas of the garment 100 to send the temperature sensed at that area, multiple heating ports 708 may be equipped with the thermal management system 700, so as to allow several heating elements or conduits 104 to be connected to the same thermal management system 700, multiple USB ports 710 and non-USB ports can be connected to the unitary garment heating device 100 allowing several equipments can be connected to the thermal management system 700 for the purpose of communications as well as charging.

These and other advantages of the invention will be further understood and appreciated by those skilled in the art by reference to the following written specification, claims and appended drawings.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated. Thus, the scope of the invention should be determined by the appended claims and their legal equivalence.

What is claimed is:

1. A garment heating device capable of being retrofitted into a garment and generating heat at a predetermined area of the garment and uniformly transferring the heat throughout the garment, comprising:

a power supply;

a conduit, the conduit comprising a unitary conductor having no junctions is connected to the power supply, wherein the conduit is configured to generate heat and is disposed in the predetermined area of the garment so as to enhance uniform distribution of the heat throughout the conduit;

a plurality of nodes having no junctions are configured to overlay the conduit from opposite sides to form a proximal layer and a distal layer around the conduit, wherein the proximal layer engages the garment, forming a barrier against the skin and the distal layer forms the opposite cover and integrates with the conduit and the proximal layer and the distal layer are configured to transfer the controlled heat generated by the conduit to the plurality of nodes of the garment thereby enabling the nodes to provide uniform heating throughout the garment; and wherein the plurality of nodes and the conduit are made of a metallic yarn coated with urethane.

2. The device of claim 1, wherein the predetermined area of the garment includes back and chest areas.

3. The device of claim 1, wherein the unitary conductor comprises a strand of metallic yarn 3.6 meters long, and having a resistance of 2.5 ohms.

4. The device of claim 1, wherein each of the nodes are spaced at a predetermined space from each other so as to provide flexibility to the garment.

5. The device of claim 1, wherein the device further includes a thermostat and a microprocessor, wherein the thermostat is operatively joined with the conduit and is configured to indicate a temperature of the garment and the microprocessor controlling the flow of current through the conduit in response to the signal received from the thermostat.

6. The device of claim 5, wherein the thermostat being configured to communicate with a communication apparatus and the communication apparatus having a software application providing a graphical user interface configured to monitor and regulate the thermostat, thereby controlling the power supply to the conduit so as to regulate the temperature based on external conditions.

7. The device of claim 1, wherein the power supply is microprocessor controlled and source of power supply includes a battery, a fuel cell, a solar cell or an external power source or any combination thereof.

8. The device of claim 1, further comprising a USB port and a battery charging circuit attached to the power supply to allow recharging of the power supply.

9. A garment heating device capable of being retrofitted into a garment and generating heat at a predetermined area of the garment and uniformly transferring the heat throughout the garment, comprising:

a power supply;

a conduit, the conduit comprising a unitary conductor having no junctions is connected to the power supply, wherein the conduit is configured to generate heat and is disposed in the predetermined area of the garment so as to enhance uniform distribution of the heat throughout the conduit;

a thermostat disposed to operatively join with the conduit, wherein the thermostat is configured to indicate a temperature of the garment;

a microprocessor for controlling the power supply to the conduit in response to the signal received from the thermostat;

a plurality of nodes having no junctions are configured to overlay the conduit from opposite sides to form a proximal layer and a distal layer around the conduit, wherein the proximal layer engages the garment, forming a barrier against the skin and the distal layer forms the opposite cover and integrates with the conduit and the layers are configured to transfer the controlled heat generated by the conduit to the plurality of nodes of the garment thereby enabling the nodes to provide uniform heating throughout the garment; and wherein the plurality of nodes and the conduit are made of the same a metallic yarn coated with urethane.

10. The device of claim 9, wherein the unitary conductor comprises a metallic yarn 3.6 meters long, and having a resistance of 2.5 ohms.

11. The device of claim 9, wherein each of the nodes are spaced at a predetermined space from each other so as to provide flexibility to the garment.

12. The device of claim 9, further comprising a USB port and a battery charging circuit attached to the power supply to allow recharging of the power supply.

13. A garment heating device capable of being retrofitted into a garment and generating heat at a predetermined area of the garment and uniformly transferring the heat throughout the garment, comprising:

a power supply;

a conduit, the conduit comprising a unitary conductor having no junctions is connected to the power supply, wherein the conduit is configured to generate heat and is disposed in the predetermined area of the garment so as to enhance uniform distribution of the heat throughout the conduit;

a thermostat disposed to operatively join with the conduit, wherein the thermostat is configured to indicate a temperature of the garment and communicates with a communication apparatus so as to monitor and regulate the thermostat, thereby controlling the power supply to the conduit;

a plurality of nodes having no junctions are configured to overlay the conduit from opposite sides to form a proximal layer and a distal layer around the conduit, wherein the proximal layer engages the garment, forming a barrier against the skin and the distal layer forms the opposite cover and integrates with the conduit and the layers are configured to transfer the controlled heat generated by the conduit to the plurality of nodes of the garment thereby enabling the nodes to provide uniform heating throughout the garment, further the plurality of nodes are spaced at a predetermined space from each other so as to provide flexibility to the garment; and wherein the plurality of nodes and the conduit are made of the same a metallic yarn coated with urethane.

14. The device of claim 13, wherein the unitary conductor comprises a metallic yarn 3.6 meters long, and having a resistance of 2.5 ohms.

15. The device of claim 13, wherein the communication apparatus is a smart phone having a software application providing a graphical user interface configured to monitor and regulate the thermostat, thereby controlling the power supply to the conduit so as to regulate the temperature based on external conditions.

16. The device of claim 13, further comprising a USB port and a battery charging circuit attached to the power supply to allow recharging of the power supply.

* * * * *